US007708116B2

(12) United States Patent
Martin et al.

(10) Patent No.: US 7,708,116 B2
(45) Date of Patent: May 4, 2010

(54) FALL ARRESTER AS PART OF A FALL PROTECTION SYSTEM FOR LADDERS AND SIMILAR CLIMBING ROUTES

(75) Inventors: Frank Martin, Hof (DE); Markus Krauβ, Feilitzsch (DE)

(73) Assignee: Christian Dalloz Holding Deutschland GmbH & Co. K,, Hof/Saale (DE)

( * ) Notice: Subject to any disclaimer, the term of this patent is extended or adjusted under 35 U.S.C. 154(b) by 1014 days.

(21) Appl. No.: 10/571,592

(22) PCT Filed: Sep. 13, 2004

(86) PCT No.: PCT/EP2004/052144

§ 371 (c)(1),
(2), (4) Date: May 10, 2006

(87) PCT Pub. No.: WO2005/026491

PCT Pub. Date: Mar. 24, 2005

(65) Prior Publication Data

US 2006/0283662 A1 Dec. 21, 2006

(30) Foreign Application Priority Data

Sep. 12, 2003 (DE) ..... 203 14 230 U

(51) Int. Cl.
*A47L 3/00* (2006.01)

(52) U.S. Cl. ..... 182/8; 182/82

(58) Field of Classification Search ..... 182/8, 182/82

See application file for complete search history.

(56) References Cited

U.S. PATENT DOCUMENTS 6,457,556 B1 * 10/2002 Skade et al. ..... 182/8
6,725,969 B1 * 4/2004 Meister ..... 182/8

FOREIGN PATENT DOCUMENTS

DE 27 36 037 2/1979
DE 88 13 567 U 12/1988

(Continued)

OTHER PUBLICATIONS

Chicago Manual Style (CMS): articulated. Dictionary.com. Dictionary.com Unabridged (v 1.1). Random House, Inc. http://dictionary.reference.com/browse/articulated (accessed: Jun. 11, 2009). (Definition Provided in Action).*

*Primary Examiner*—Katherine W Mitchell
*Assistant Examiner*—Daniel Cahn
(74) *Attorney, Agent, or Firm*—Buchanan Ingersoll & Rooney PC

(57) ABSTRACT

A catch device, as part of a fall protection for ladders and similar climbing devices, for application in a guide rail with a C-profile, includes a body and at least two pairs of rollers, arranged in the body so as to run inside the guide rail. At least one pair of rollers is rigidly fixed to the body and one roller pair is arranged to pivot about an axis at right angles to the longitudinal axis of the guide rail and which runs up to the rotational axis of the roller pair. The pivoting roller pair can be fixed in a secure position such that the pivoting roller pair is fixed on a shaft, mounted so as to rotate in the body, the upper end of the shaft projecting from the body and having an indent. A hanging latch is connected to the body which may engage in the indent. The hanging latch can be locked in the engaged position.

13 Claims, 4 Drawing Sheets

FOREIGN PATENT DOCUMENTS

EP 0 168 021 1/1986

EP 168021 A1 * 1/1986

* cited by examiner

Figure 1:
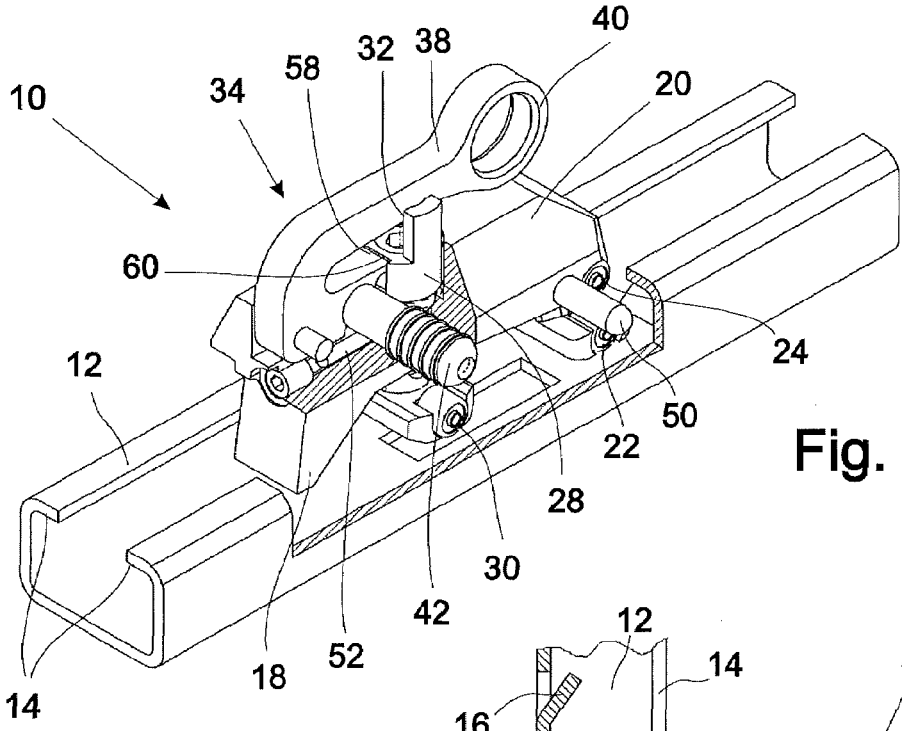

FALL ARRESTER AS PART OF A FALL PROTECTION SYSTEM FOR LADDERS AND SIMILAR CLIMBING ROUTES

This application is a national stage application under 35 USC 371 of International Application No. PCT/EP2004/052144, filed Sep. 13, 2004, the international Application being published in German. The application also claims priority of German Application No. 203 14 230.6, filed Sep. 12, 2003, the contents of each application hereby being incorporated by reference in their entirety for all purposes.

The invention relates to a fall arrester which forms part of a fall protection system for ladders and similar climbing routes and can be inserted into a guide rail with a C-profile. The fall arrester has a body and two pairs of rolls which are arranged on the body so that they run inside the guide rail.

Such a fall arrester is known from EP 0 168 021. Both pairs of rolls are arranged swivellably about an axis which runs at right angles to the longitudinal axis of the guide rail and to the axis of rotation of this pair of rolls. Due to the swivellable arrangement of the pair of rolls the fall arrester can be inserted into the guide rail at any point. For insertion the pairs of rolls are swivelled so that the axis of rotation of the rolls points in the longitudinal direction of the rail. After insertion of the fall arrester into the guide rail the pairs of rolls are then swivelled into their normal or secure position and secured in this position.

A fall arrester is known from DE 27 36 037 in which the parts which grip around one guide flange of the guide rail are swivellable about an axis which runs parallel to the guide rail. These parts can thereby be moved in the direction of the parts of the fall arrester gripping around the other guide flange, whereby the fall arrester can then be removed from the guide rail. To lock the fall arrester in the secure position a threaded bolt is tightened by means of a box spanner or an additional locking pin is provided.

The object of the invention is to simplify the design of the fall arrester and at the same time to increase the operational safety.

According to the invention this object is achieved in that one pair of rolls is arranged rigid against the body and the other pair of rolls is arranged swivellable about an axis which runs at right angles to the longitudinal axis of the guide rail and to the axis of rotation of this pair of rolls.

By having one pair or rolls arranged rigid, a possible source of errors is excluded and the design is simplified at the same time.

The swivellable pair of rolls can preferably be fixed in the secure position. The fixing can take place in that the swivellable pair of rolls is attached to a shank housed rotatable in the body and the end of the shank projects from the body and has a diametral indent. Articulated to the body is a lever which can be inserted into the indent and locked in this position by a stop bolt.

The lever which can be inserted into the indent is preferably one leg of a U-shaped suspended ratchet. The suspended ratchet is preferably articulated to the body at the base of its U-shape. On the free leg of the U-shape, an eyelet is provided for securing the safety belt of the personal safety equipment. If the fall arrester engages in the guide rail in the event of a fall, the U-shape of the suspended ratchet is bent upwards, whereby the catching impact is additionally attenuated.

Above the rigid pair of rolls a third pair of rolls is preferably arranged, which is also rigid. This pair of rolls runs on the outside of the guide rail so that the two guide flanges which delimit the opening of the C-profile lie between the two rigid pairs of rolls. A largely frictionless movement of the fall arrester in the guide rail is thereby achieved.

The two rigid pairs of rolls are usually arranged at the front end of the fall arrester, while the swivellable pair of rolls are arranged approximately in the middle of the fall arrester. The rear end is formed as a catching pawl, which is integral with the body. The axis of rotation of the swivellable pair of rolls is loaded towards the body by a compression spring so that, in the normal case, and during forward movement, the catching pawl is pushed towards the catching stop which is formed in the back of the guide rail. In the event of a fall, if the fall arrester is pulled backwards, the catching pawl impacts against the catching stop and the fall arrester is thereby locked in the guide rail.

The catching pawl can also be formed in the body as a movable element under spring tension, the swivellable pair of rolls expediently being arranged at the rear end of the body, while the catching pawl is then articulated in the middle of the body.

To insert the fall arrester into the guide rail, the fall arrester is first held at right angles to the guide rail and inserted with the front, lower, rigid pair of rolls into the opening of the C-profile of the guide rail. The fall arrester is then with its rear end swivelled down by 90° C., so that the swivellable pair of rolls and the catching pawl can also be inserted into the opening of the C-profile. The swivellable pair of rolls is located in its inserted position, in which the axis of rotation of the pair of rolls points in the longitudinal direction of the guide rail. After the insertion of the swivellable pair of rolls and the catching pawl into the opening of the guide rail the swivellable pair of rolls is swivelled by 90° C., so that it now lies across in the guide rail. In this position it is locked in the manner already mentioned above.

The guide rail is generally vertical. In order to prevent the fall arrester from being inserted upside down, with the front end pointing downwards, a device is provided which in this case prevents the swivelling of the swivellable pair of rolls into the secure position and the swinging shut of the suspended ratchet. This device consists of two opposed longitudinal grooves, facing the rolls, milled in the shank of the swivellable pair of rolls. In the inserted position one of the two longitudinal grooves points towards the rear end of the fall arrester. From the bore in which the shank of the swivellable pair of rolls is housed, a longitudinal bore a few millimeters thick leads to the rear end of the fall arrester. A cylindrical pin loosely slides in this longitudinal bore. If the fall arrester is inserted upside down, i.e. head first, the cylindrical pin drops through the action of gravity into the longitudinal groove of the shank and thereby locks the shank against rotation.

The body of the fall arrester is expediently made from aluminium or stainless steel. The suspended ratchet, which must bend upwards in the event of a fall, expediently consists of steel with a tensile strength of 480 to 600 N/mm$^2$.

Figure 2:
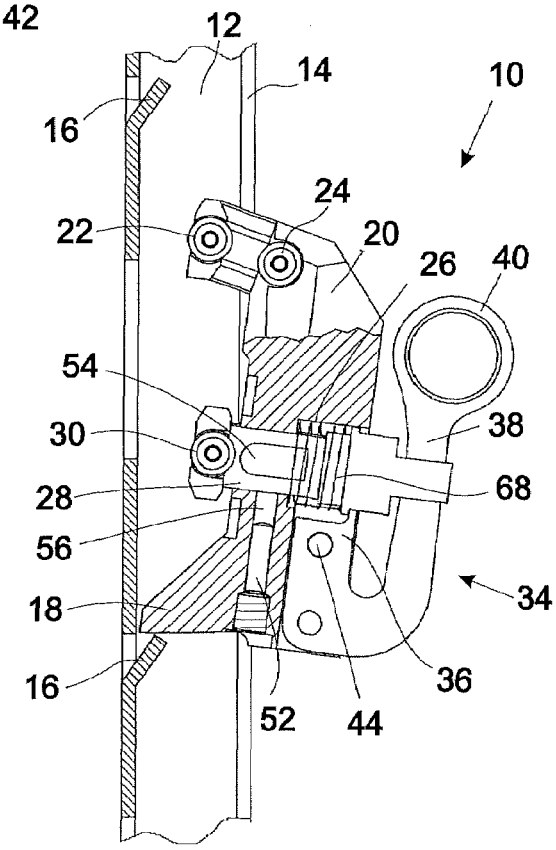
Figure 3:
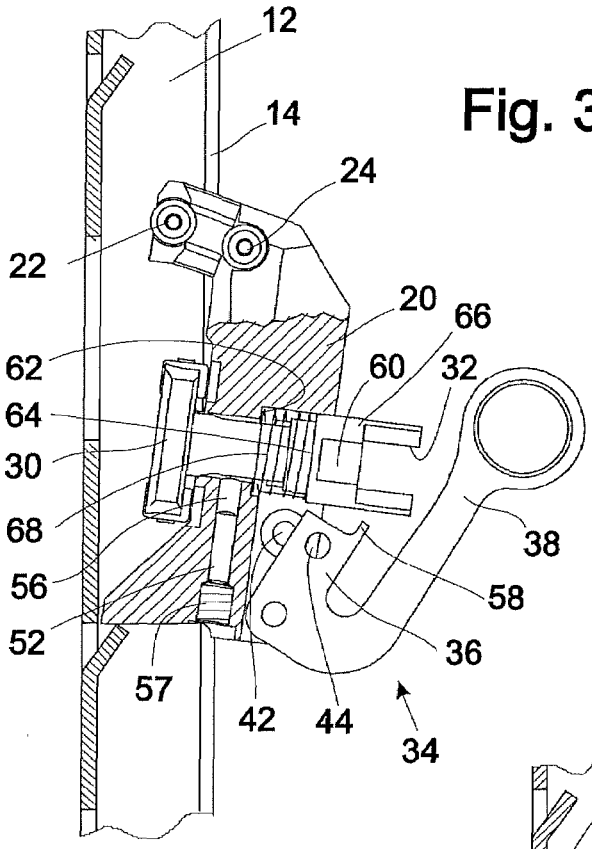
Figure 4:
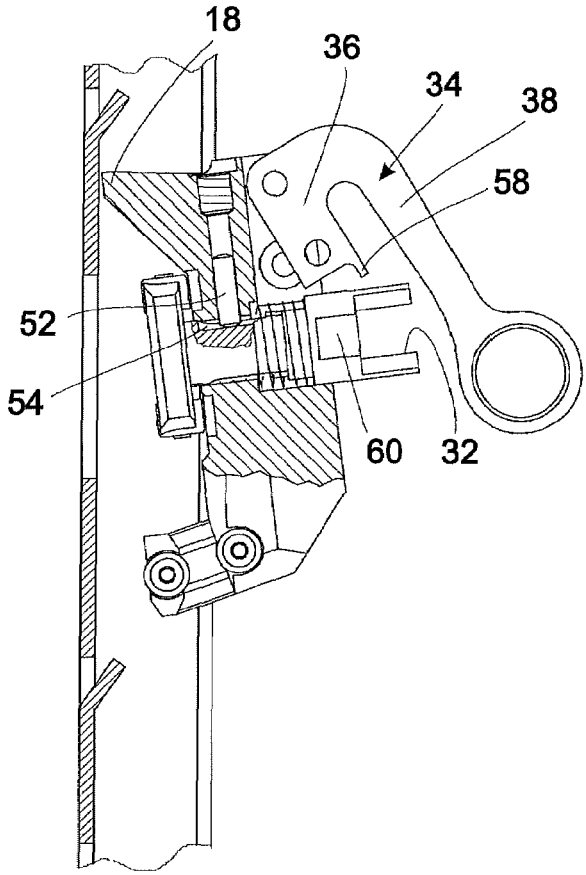

An embodiment of the invention is explained below with reference to the drawings. These show:

FIG. 1 a perspective representation of the fall arrester inserted into a guide rail, part being broken away;

FIG. 2 the fall arrester inserted into a guide rail in section;

FIG. 3 a representation similar to that of FIG. 2, the suspended ratchet being open;

FIG. 4 a representation similar to that of FIG. 2, but with the fall arrester inserted head first and FIGS. 5 to 8 in four steps the insertion of the fall arrester into the guide rail.

According to FIGS. 1 and 2 the fall arrester 10 is guided in a guide rail 12. The guide rail 12 is normally vertical. It has a C-profile open to the front, i.e. towards the user, the opening being laterally delimited by two guide flanges 14. In the back of the guide rail catching stops 16 are pressed out, protruding into the guide rail 12.

The fall arrester 10 has a body 20, oblong overall, extending in the direction of the guide rail with a catching pawl 18. At the front end of the body 20, two pairs of rolls 22, 24 are provided. The inner pair of rolls 22 run on the inside of the guide flange 14, while the outer pair of rolls 24 run on the outside of the guide flange 14. The rolls 22, 24 are housed on journals which are attached rigidly to the body 20. The inner rolls 22 are at a distance from the outer rolls 24, which is somewhat greater than the material thickness of the guide flange 14.

Housed rotatable in a bore 26 of the body 20 is a shank 28, the axis of rotation lying approximately perpendicular to the front of the guide rail 12. At the end of the shank 28 projecting towards the guide rail 12, a rear pair of rolls 30 with an axis of rotation lying across the shank axis is arranged. By rotating the shank 28, the axis of rotation of the pair of rolls 30 can be swivelled parallel to the longitudinal direction of the guide rail 12, the pair of rolls 30 then being located in the inserted position. The pair of rolls 30 can also be swivelled across the guide rail 12, so that its axis of rotation lies parallel to the axes of rotation of the inner and outer rolls 22, 24. The pair of rolls 30 is then in the secure position. The end of the shank 28 projecting on the upper side of the body 20 has a transverse indent 32. On the upper side of the body 20 a suspended ratchet 34 is also articulated to the rear end of the body 20. The suspended ratchet 34 is U-shaped, its centre of rotation lying in the region of the bend of the U-shape. The lower leg 36, lying closer to the body 20, lies in a milled recess in the upper side of the body 20. The upper leg 38 is longer than the lower leg 36 and extends beyond the shank 28. At its front end an eyelet 40 is provided for securing the safety belt of the user's personal safety equipment. If the swivellable pair of rolls 30 is in the secure position, the indent 32 points in the longitudinal direction and the upper leg 38 of the suspended ratchet 34 can be inserted into this indent 32. The shank 28 and the swivellable pair of rolls 30 are thus locked against swivelling. The suspended ratchet 34 is secured in this shut position by a stop bolt 42. The stop bolt 42 is attached laterally against the body 20 and pierces the lower leg 36 of the suspended ratchet 34. The stop bolt 42 slopes at its front end so that it is pushed out when the suspended ratchet 34 swings shut and then engages in a bore 44 provided for this purpose at the front end of the lower leg 36.

A catching pawl 18 is formed at the rear end of the body 20 integral with the latter. It slopes rearward, so that upon a forward movement of the fall arrester it travels over the catching stops 16 sloping in the same direction. In the event of a fall the catching pawl would move backwards, so that the catching pawl 18 then strikes the catching stop 16, and thereby locks the fall arrester 10 in the guide rail 12.

In order to ensure that the fall arrester 10 acts as a catch in the event of a fall, the fall arrester 10 must be inserted into the guide rail 12 correctly aligned. As usual, for this a pin 50 projects laterally to the right from the body 20 of the fall arrester. On the opposite side, i.e. on the left in the present case, of the guide rail a corresponding stop is provided, which the pin 50 strikes if the fall arrester 10 is incorrectly inserted into the guide rail 12. This stop is usually provided only at the upper and lower ends of the guide rail, as the fall arrester is customarily inserted only at these points. As the fall arrester 10 according to the invention can be inserted at any point of the guide rail 12, an additional device is provided which warns the user of incorrect insertion of the fall arrester 10. This device consists of a cylindrical pin 52 and two longitudinal grooves 54 which are cut into the cylinder surfaces of the shank 28 at opposite points. The cylindrical pin 52 slides freely in a bore 56 which extends from the bore 26 for the shank 28 to the rear end of the body 20. The rear opening of the longitudinal bore 56 is sealed by a grub screw 57 (FIG. 3). If the fall arrester 10 is inserted wrongly aligned into the guide rail 12, the cylindrical pin 52 drops under its own weight into one of the longitudinal grooves 54, thereby blocking swivelling of the pair of rolls 30 (FIG. 4). The longitudinal grooves 54 are attached to the sides facing the rolls 30, so that the pair of rolls 30 cannot then be swivelled into the secure position and the suspended ratchet 34 cannot be swung shut. The user is thereby warned of an incorrect alignment of the fall arrester.

A nose 58 projects from the front end of the lower leg 36 of the suspended ratchet 34, engaging in an indent 60 at the upper end of the shank 28 if the swivellable pair of rolls 30 is in the secure position. In the event of a fall the U-shape of the suspended ratchet 34 is bent upwards, the catching impact thereby being attenuated. The upper leg 38 is pulled out of the indent 32 in the process. The engagement of the nose 58 in the indent 60, ensures that the swivellable pair of rolls 30 remains in the secure position even if the upper leg 38 is pulled out of the indent 32.

The bore 26 has a shoulder 62 and is widened in the upper section. The shank 28 has a corresponding counter-shoulder 64 and a widened head 66, in which the indent 32 is provided. A compression spring 68 is supported between the shoulder 62 and counter-shoulder 64. The swivellable pair of rolls 30 are therefore pulled towards the inside of the guide flange 14, whereby the catching pawl 18 is pushed towards the back of the guide rail 12 and thus towards the catching stops 16. It is thereby guaranteed that in the event of a fall the fall arrester will be safely caught in the guide rail 12.

Figure 5:
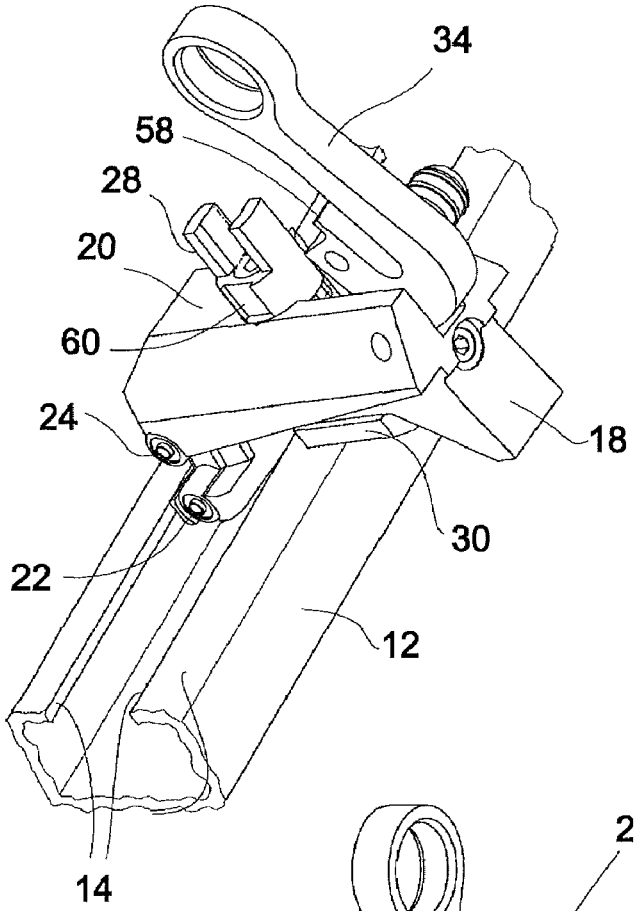

The insertion of the fall arrester 10 is now explained with reference to FIGS. 5-8:

As shown in FIG. 5, the fall arrester 10 is held across the guide rail 12 and the inner, rigid rolls 22 are inserted through the opening of the C-profile of the guide rail 12 in the process. The suspended ratchet 34 is swung open and the swivellable pair of rolls 30 swivelled into the inserted position, in which the axis of rotation of the rolls 30 points in the longitudinal direction of the fall arrester 10.

Figure 6:
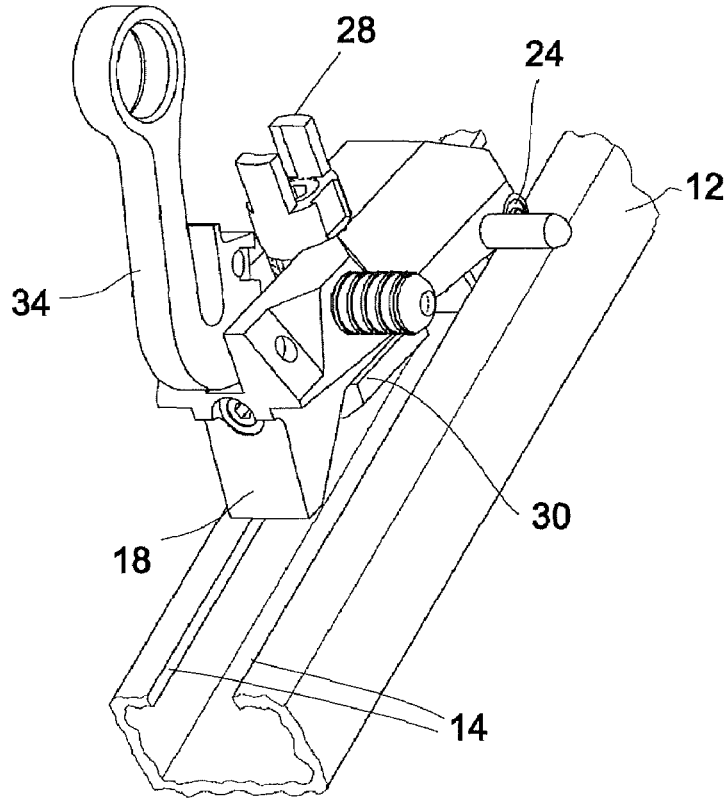
Figure 7:
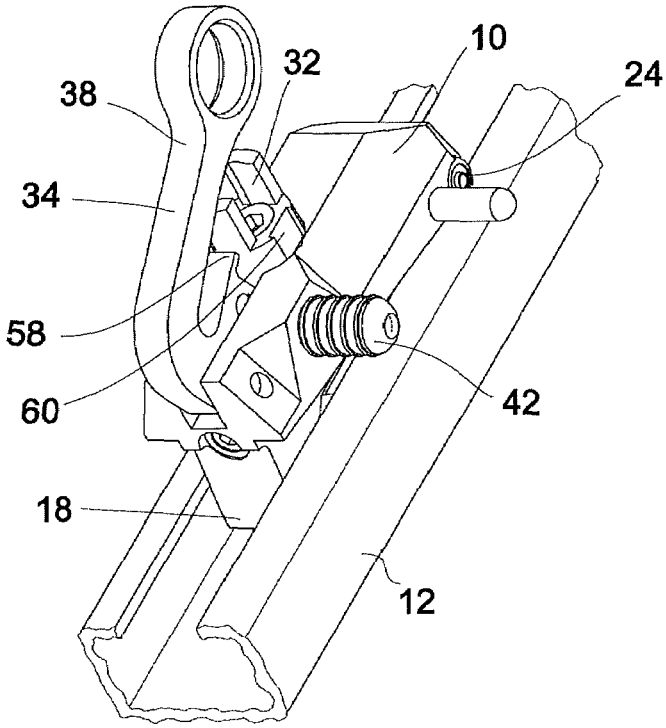
Figure 8:
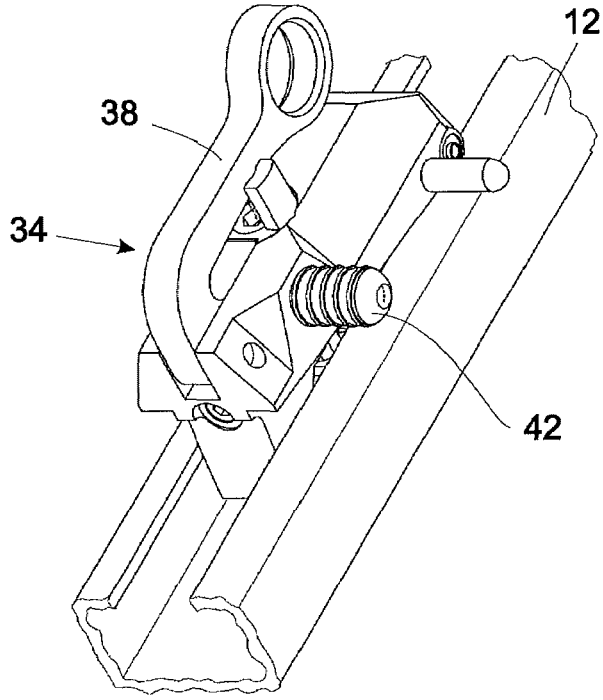

The fall arrester 10 is then swivelled into the position shown in FIG. 6, care needing to be taken that the guide flange 14 comes to rest between the inner rolls 22 and the outer rolls 24 in the process. The rear end of the fall arrester 10 is further raised somewhat from the guide rail 12. In order to make this raised position possible, the inner rolls 22 are offset slightly forwards vis-à-vis the outer rolls 24. The fall arrester 10 is then swivelled with its rear end towards the guide rail 12, so that the swivellable pair of rolls 30 and the catching pawl 18 are now also inserted through the opening of the C-profile into the guide rail 12, as shown in FIG. 7.

The shank 28 and thus the pair of rolls 30 are then swivelled by 90°, so that the pair of rolls 30 are transversely aligned and lie parallel to the rolls 22, 24. Finally the suspended ratchet 34 swings shut, the upper leg 38 coming to rest in the indent 32 in the head of the shank 28. On the swinging shut of the suspended a ratchet 34, the stop bolt 42 engages in the bore 44 on the lower leg 36 of the suspended ratchet 34, see FIG. 8. The fall arrester 10 is then ready for use.

LIST OF REFERENCES

10 Fall arrester
12 Guide rail
14 Guide flange
16 Catching stops
18 Catch
20 Body
22 Inner rolls
24 Outer rolls

26 Bore
28 Shank
30 Pair of rolls
32 Indent
34 Suspended ratchet
36 Lower leg
38 Upper leg
40 Eyelet
42 Stop bolt
44 Bore
50 Pin
52 Cylindrical pin
54 Longitudinal grooves
56 Longitudinal bore
57 Grub screw
58 Nose
60 Indent
62 Shoulder
64 Counter-shoulder
66 Head
68 Spring

The invention claimed is:

1. A fall arrester which forms part of a fall protection system for ladders and similar climbing routes and is adapted to be inserted into a guide rail with a C-profile, the guide rail defining a longitudinal plane, the fall arrester comprising:

a body defining a front end and a rear end of the fall arrester and at least a first and a second pair of rolls which are arranged on the body and are adapted to run inside the guide rail, the first and second pair of rolls having a first and second axis of rotation respectively;

wherein the first pair of rolls is arranged rigid against the body;

wherein the second pair of rolls is arranged swivellable about a swivel axis which runs at a right angle to the longitudinal plane of the guide rail whereby the second pair of rolls is adapted to be swivelled within a second plane parallel to the longitudinal plane defined by the guide rail, the second pair of rolls then capable of being located in an inserting position, and then capable of being swivelled within the longitudinal plane defined by the guide rail, where the second pair of rolls then being positioned in a securing position;

wherein the second pair of rolls is adapted to be fixed in the securing position;

wherein the second pair of rolls is directly attached to a shank housed rotatably in the body, the upper end of the shank projects from the body and has an indent;

wherein a suspended ratchet is articulated to the body and is adapted to be inserted into the indent;

wherein two longitudinal grooves are milled on opposite sides in the shank of the second pair of rolls;

wherein a first longitudinal bore leads from a second bore in which the shank of the second pair of rolls is housed to the rear end of the fall arrester; and wherein in the first longitudinal bore a cylindrical pin loosely slides and the pin is adapted to drop under the action of gravity into one of the longitudinal grooves of the shank, thereby able to lock the shank against rotation in the event of the fall arrester being inserted incorrectly.

2. The fall arrester of claim 1, wherein the suspended ratchet is adapted to be locked in the inserting position.

3. The fall arrester of claim 2, wherein the suspended ratchet is U-shaped and has an upper and lower leg and a bend therebetween.

4. The fall arrester of claim 3, wherein the lower leg lies closer to the body, the upper leg is longer than the lower leg and extends beyond the shank, the suspended ratchet is articulated at the bend of its U-shape to the body, an eyelet is provided on a front end of the upper leg for securing a safety belt of personal safety equipment and the lower leg is able to be locked against the body.

5. The fall arrester of claim 4, wherein arranged above the rigid, first pair of rolls is a third pair of rolls, which is also rigid, and the first pair of rolls and third pair of rolls has an arrangement such that one of the first and third rigid pair of rolls runs on the inside of the guide rail and the other rigid pair of the first and third rigid pair of rolls runs on an outside of the guide rail.

6. The fall arrester of claim 1, wherein the rigid pair of rolls is arranged at the front end of the fall arrester, while the swivellable pair of rolls is arranged approximately in the middle of the fall arrester and the rear end of the body is formed as a catching pawl.

7. A fall arrester which forms part of a fall protection system for ladders and similar climbing routes and is adapted to be inserted into a guide rail with a C-profile, the guide rail defining a longitudinal plane, the fall arrester comprising:

a body defining a front end and a rear end of the fall arrester and at least a first and a second pair of rolls which are arranged on the body and are adapted to run inside the guide rail, the first and second pair of rolls having a first and second axis of rotation respectively;

wherein the first pair of rolls is arranged rigid against the body;

wherein the second pair of rolls is arranged swivellable about a swivel axis which runs at a right angle to the longitudinal plane of the guide rail whereby the second pair of rolls is adapted to be swivelled in a plane which is parallel to the longitudinal plane defined by the guide rail, the second pair of rolls then capable of being located in an inserting position, and then capable of being swivelled within the longitudinal plane defined by the guide rail, where the second pair of rolls is in a securing position;

wherein the second pair of rolls is adapted to be fixed in the securing position;

wherein the first pair of rolls is arranged at the front end of the fall arrester while the second pair of rolls is arranged approximately in the middle of the fall arrester;

wherein the rear end of the body is formed as a catching pawl; and wherein the second pair of rolls is loaded towards the body by a spring in the direction of the swivel axis, so that the catching pawl is pushed towards a catching stop formed in the guide rail.

8. The fall arrester of claim 7, wherein the swivellable pair of rolls is directly attached to a shank housed rotatably in the body, the upper end of the shank projects from the body and has an indent, wherein a suspended ratchet is articulated to the body and is adapted to be inserted into the indent.

9. The fall arrester of claim 8, wherein the suspended ratchet is adapted to be locked in the inserting position.

10. The fall arrester of claim 9, wherein the suspended ratchet is U-shaped and has an upper and lower leg and a bend therebetween.

11. The fall arrester of claim 10, wherein the suspended ratchet is articulated at the bend of its U-shape to the body, an eyelet is provided on the upper leg for securing a safety belt of personal safety equipment and the lower leg is able to be locked against the body.

12. The fall arrester of claim 11, wherein arranged above the rigid, first pair of rolls is a third pair of rolls, which is also rigid, and the first pair of rolls and third pair of rolls has an arrangement such that one of the first and third rigid pair of rolls runs on the inside of the guide rail and the other rigid pair of the first and third rigid pair of rolls runs on an outside of the guide rail.

13. The fall arrester of claim 7, wherein two longitudinal grooves are milled on opposite sides in the shank of the second pair of rolls, wherein a first longitudinal bore leads from a second bore in which the shank of the second pair of rolls is housed to the rear end of the fall arrester, wherein in the first longitudinal bore a cylindrical pin loosely slides and the pin is adapted to drop under the action of gravity into one of the longitudinal grooves of the shank and, thereby able to lock the shank against rotation in the event of the fall arrester being inserted incorrectly.

* * * * *